US009285710B2

(12) United States Patent
Murata et al.

(10) Patent No.: US 9,285,710 B2
(45) Date of Patent: Mar. 15, 2016

(54) UNTRANSFERRED TONER RECOVERY DEVICE AND IMAGE FORMING APPARATUS

(71) Applicant: KYOCERA Document Solutions Inc., Osaka (JP)

(72) Inventors: Koji Murata, Osaka (JP); Tatsuhiko Yoshii, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 14/719,379

(22) Filed: May 22, 2015

(65) Prior Publication Data

US 2015/0346639 A1 Dec. 3, 2015

(30) Foreign Application Priority Data

May 27, 2014 (JP) ..... 2014-109021

(51) Int. Cl.
*G03G 15/08* (2006.01)

(52) U.S. Cl.
CPC ..... *G03G 15/0891* (2013.01)

(58) Field of Classification Search
CPC ..... G03G 15/0891; G03G 15/0889; G03G 15/0827
See application file for complete search history.

(56) References Cited

U.S. PATENT DOCUMENTS

2005/0220515 A1* 10/2005 Wakana ..... G03G 21/12 399/358
2012/0050438 A1* 3/2012 Wada ..... B65H 23/1955 347/104

FOREIGN PATENT DOCUMENTS

JP 11-167327 6/1999

* cited by examiner

*Primary Examiner* — Clayton E Laballe
*Assistant Examiner* — Victor Verbitsky
(74) *Attorney, Agent, or Firm* — Wenderoth, Lind & Ponack, L.L.P.

(57) ABSTRACT

In an initial recovery stage of untransferred toner, a conveying stirring screw is rotated at a high speed by using a second driving path. When the amount of collected untransferred toner increases and the rotating torque of the conveying stirring screw reaches a setting torque value of a second torque limiter, a driving path is switched to a first driving path, so that the conveying stirring screw is rotated at a low speed. When the amount of the collected untransferred toner further increases and the rotating torque of the conveying stirring screw reaches a setting torque value of a first torque limiter, the first driving path is also disconnected to block torque transfer to the conveying stirring screw.

3 Claims, 4 Drawing Sheets

UNTRANSFERRED TONER RECOVERY DEVICE AND IMAGE FORMING APPARATUS

CROSS-REFERENCE TO RELATED APPLICATION

This application is based upon and claims the benefit of priority from Japanese Patent Application No. 2014-109021 filed on May 27, 2014, the entire contents of which are incorporated herein by reference.

BACKGROUND

The technology of the present disclosure relates to an image forming apparatus and an untransferred toner recovery device installed therein.

In an image forming apparatus, when toner attached to an electrostatic latent image of a photosensitive drum is transferred to a recording paper, a part of the toner remains on the photosensitive drum after the transfer. The untransferred toner is removed from the surface of the photosensitive drum by a cleaning unit and is collected in a recovery container of an untransferred toner recovery device as waste toner. When the recovery container is fully filled with the untransferred toner, the recovery container is exchanged to an empty recovery container.

There has been proposed an untransferred toner recovery device in which a conveying stirring screw and a float plate have been disposed in the recovery container. In the untransferred toner recovery device, collected untransferred toner is conveyed by the conveyance stirring screw and is stirred to be unifomized, and when the float plate is pushed up by the untransferred toner increased with the passage of time, a photointerrupter is configured to detect this fact and detect that the amount of collected toner has reached a predetermined amount.

SUMMARY

An untransferred toner recovery device according to one aspect of the present disclosure includes a recovery container that collects untransferred toner removed from a surface of a photosensitive drum by a cleaning unit as waste toner. A conveying stirring screw is provided in the recovery container to be connected to a driving source via a driving path, and to stir and uniformize the collected untransferred toner while conveying the untransferred toner by a rotation operation thereof.

A torque limiter is provided to the driving path. The torque limiter detects the rotating torque of the conveying stirring screw and blocks torque transfer to the conveying stirring screw by disconnecting the driving path when the rotating torque increases up to a setting value according to an increase in the amount of the collected toner.

An image forming apparatus according to another aspect of the present disclosure includes the untransferred toner recovery device.

DETAILED DESCRIPTION

Hereinafter, an embodiment of the technology of the present disclosure will now be described with reference to the drawings.

Figure 1:
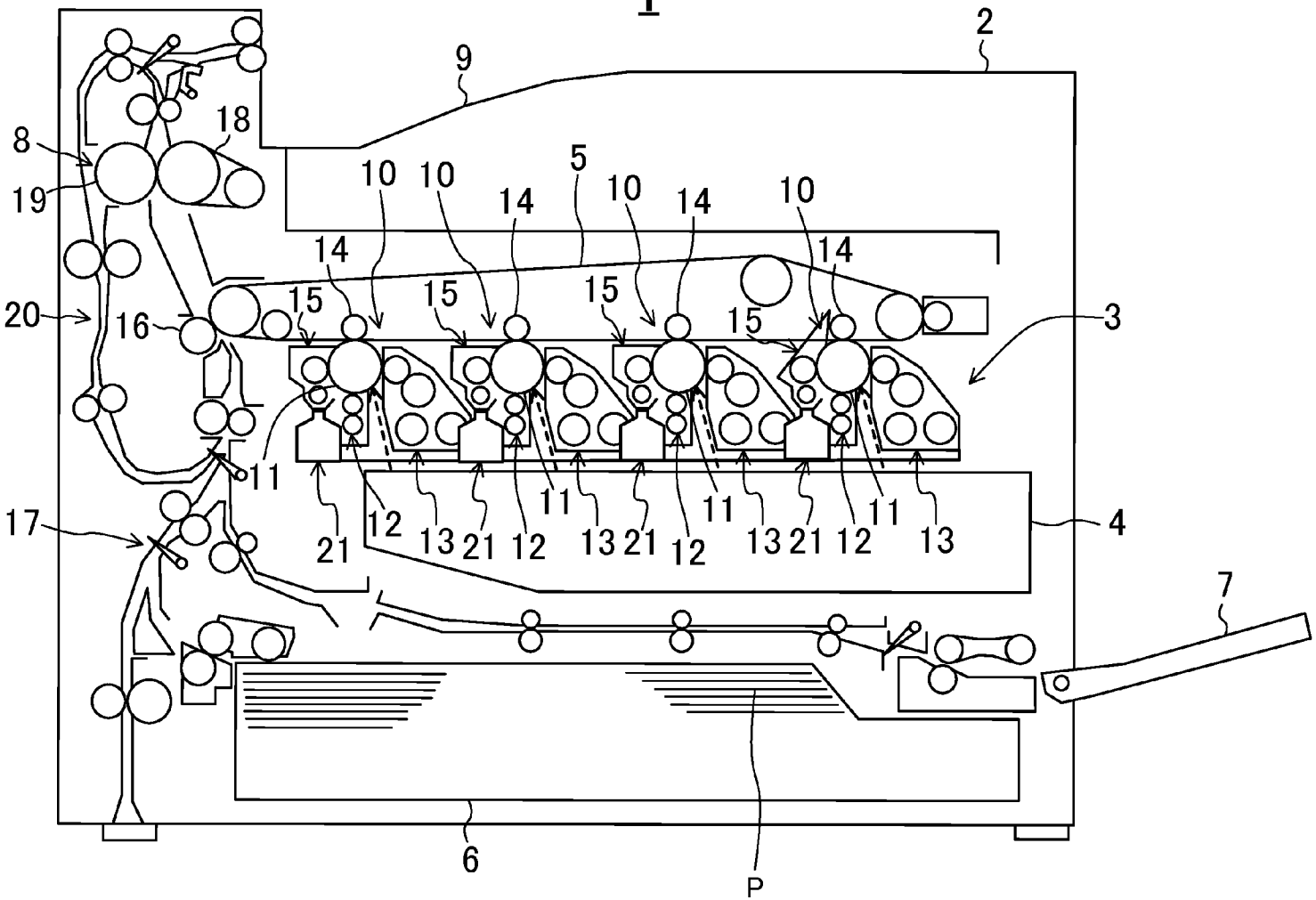
FIG. 1 is a schematic configuration diagram of an image forming apparatus provided with an untransferred toner recovery device according to an embodiment.

FIG. 1 is a schematic configuration diagram of an image forming apparatus 1 provided with an untransferred toner recovery device according to an embodiment. The image forming apparatus 1 is a tandem type color printer and includes an image forming unit 3 in a box-like casing 2. The image forming unit 3 is a part that transfers and forms an image to a recording paper P on the basis of image data transmitted from an external device such as a network-connected computer. Below the image forming unit 3, an exposure device 4 is disposed to irradiate laser light, and above the image forming unit 3, a transfer belt 5 is disposed. Under the exposure device 4, a paper storage unit 6 is disposed to store the recording paper P, and at a lateral side of the paper storage unit 6, a manual paper feeding unit 7 is disposed. Above the lateral side of the transfer belt 5, a fixing unit 8 is disposed to perform a fixing process on the image transferred to the recording paper P. A reference numeral 9 indicates a paper discharge unit disposed at an upper portion of the casing 2 to discharge the recording paper P subjected to the fixing process in the fixing unit 8.

The image forming unit 3 includes four image forming units 10 disposed in a row along the transfer belt 5. Each of the image forming units 10 has a photosensitive drum 11. Directly under each photosensitive drum 11, a charging device 12 is disposed, and at one lateral side of each photosensitive drum 11, a developing device 13 is disposed. Directly above each photosensitive drum 11, a primary transfer roller 14 is disposed, and at the other lateral side of each photosensitive drum 11, a cleaning unit (hereinafter, referred to as a cleaning device) 15 is disposed to clean a peripheral surface of each photosensitive drum 11.

The peripheral surface of each photosensitive drum 11 is uniformly charged by the charging device 12, and laser light corresponding to each color based on the image data input from the computer and the like is irradiated to the peripheral surface of each charged photosensitive drum 11 from the exposure device 4, so that an electrostatic latent image is formed on the peripheral surface of each photosensitive drum 11. A developer is supplied to the electrostatic latent image from the developing device 13, so that a yellow, magenta, cyan, or black toner image is formed on the peripheral surface of each photosensitive drum 11. These toner images are respectively superposed on and transferred to the transfer belts 5 by a transfer bias applied to the primary transfer roller 14.

A reference numeral 16 indicates a secondary transfer roller disposed below the fixing unit 8 in contact with the transfer belt 5, and the secondary transfer roller 16 is configured to interpose the recording paper P conveyed along a paper conveyance path 17 from the paper storage unit 6 or the manual paper feeding unit 7 between the secondary transfer roller 16 and the transfer belt 5, and to transfer the toner images on the transfer belt 5 to the recording paper P by a transfer bias applied to the secondary transfer roller 16.

The fixing unit 8 includes a heating roller 18 and a pressing roller 19, and is configured to heat and press the recording paper P while interposing the recording paper P between these heating roller 18 and pressing roller 19, thereby fixing the toner images, which have been transferred to the recording paper P, to the recording paper P. The recording paper P subjected to the fixing process is discharged to a paper discharge unit 9. A reference numeral 20 indicates a reversing conveyance path for reversing the recording paper P discharged from the fixing unit 8 at the time of duplex printing.

Below each cleaning device 15, an untransferred toner recovery device 21 according to the embodiment is disposed. As described in FIG. 2, the untransferred toner recovery device 21 includes a recovery container 22 that collects untransferred toner, which has been removed from the surface of the photosensitive drum 11 by using a cleaning blade (not illustrated) of the cleaning device 15, as waste toner.

From an upper portion of one end side of the recovery container 22, a toner inlet 22*a* with an opened upper side protrudes. In the recovery container 22, a conveying stirring screw 23 is disposed. The conveying stirring screw 23 is configured to be connected to a driving motor 24 serving as a driving source via a driving path 25, and to stir and uniformize the untransferred toner collected in the recovery container 22 while conveying the untransferred toner to a deep portion of the recovery container 22 through a rotation operation thereof.

The driving path 25 is provided with a torque limiter that detects rotating torque of the conveying stirring screw 23 and blocks torque transfer to the conveying stirring screw by disconnecting the driving path 25 when the rotating torque increases up to a setting value according to an increase in the amount of collected toner.

A first gear 26*a* provided at one end (the left end of FIG. 2) of a first transfer shaft 26 is engaged with an output gear 24*a* of the driving motor 24, and a first torque limiter 27 is connected to the other end (the right end of FIG. 2) of the first transfer shaft 26.

Figure 2:
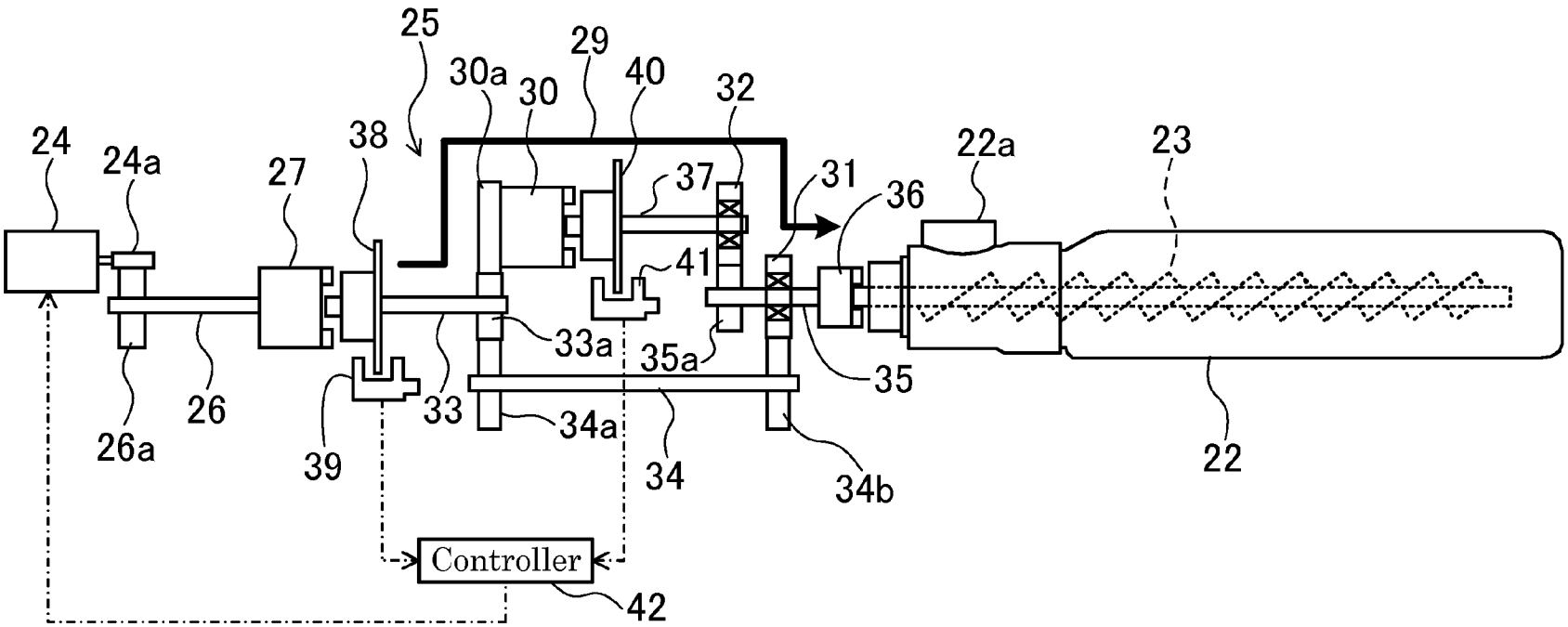
FIG. 2 is an explanation diagram for explaining that untransferred toner is in an initial recovery stage in an untransferred toner recovery device according to an embodiment.

The driving path has a first driving path 28 (see FIG. 3) and a second driving path 29 (see FIG. 2).

The torque limiter has a second torque limiter 30 provided to the second driving path 29 in addition to the first torque limiter 27. Setting torque of the first torque limiter 27 is set to be larger than that of the second torque limiter 30.

An upstream side (the left end of FIG. 2) of the first driving path 28 and the second driving path 29 is connected to the first torque limiter 27. A downstream side (the right end of FIG. 2) of the first driving path 28 is connected to the conveying stirring screw 23 via a first one-way clutch 31, and a downstream side (the right end of FIG. 2) of the second driving path 29 is connected to the conveying stirring screw 23 via a second one-way clutch 32.

In detail, the other end (the left end of FIG. 2) of a second transfer shaft 33 having a second gear 33*a* is connected to one end (the right end of FIG. 2) of the first torque limiter 27, and the second gear 33*a* is engaged with a third gear 34*a* provided at one end (the left end of FIG. 2) of a third transfer shaft 34. A fourth gear 34*b* is provided at the other end (the right end of FIG. 2) of the third transfer shaft 34 and is engaged with the first one-way clutch 31. The first one-way clutch 31 is provided in the middle of a fourth transfer shaft 35 and one end (the right end of FIG. 2) of the fourth transfer shaft 35 is connected to the conveying stirring screw 23 via a coupling 36.

Furthermore, the second gear 33*a* is engaged with a fifth gear 30*a* provided to the second torque limiter 30. One end (the left end of FIG. 2) of a fifth transfer shaft 37 is connected to the second torque limiter 30 and the second one-way clutch 32 is provided at the other end (the right end of FIG. 2) of the fifth transfer shaft 37. The second one-way clutch 32 is engaged with a sixth gear 35*a* provided at the other end (the left end of FIG. 2) of the fourth transfer shaft 35.

A first disc 38 is provided at a lateral side of the first torque limiter 27 of the second transfer shaft 33, a first photointerrupter 39 serving as a first detection unit is attached to the first disc 38, and by the operation of the first torque limiter 27, that is, the rotating torque of the conveying stirring screw 23 reaches a setting torque value of the first torque limiter 27 and the first torque limiter 27 slips, so that the rotation of the first disc 38 is stopped, the first driving path 28 is disconnected, and the first photointerrupter 39 is configured to detect that the torque transfer has been blocked.

A second disc 40 is provided at a lateral side of the second torque limiter 30 of the fifth transfer shaft 37, a second photointerrupter 41 serving as a second detection unit is attached to the second disc 40, and by the operation of the second torque limiter 30, that is, the rotating torque of the conveying stirring screw 23 reaches a setting torque value of the second torque limiter 30 and the second torque limiter 30 slips, so that the rotation of the second disc 40 is stopped, the second driving path 29 is disconnected, and the second photointerrupter 41 detects that the torque transfer has been blocked.

These first photointerrupter 39 and second photointerrupter 41 are connected to a controller 42 serving as a control unit. The controller 42 controls the entire image forming apparatus 1 and is also connected to the driving motor 24.

In an initial recovery stage of untransferred toner illustrated in FIG. 2, the second one-way clutch 32 is engaged with the fifth transfer shaft 37 and is drive-connected to the conveying stirring screw 23 via the sixth gear 35*a* and the fourth transfer shaft 35. At this time, since the rotating torque of the conveying stirring screw 23 is not high enough to reach the setting torque values of the first torque limiter 27 and the second torque limiter 30 and both the first torque limiter 27 and the second torque limiter 30 do not operate (slip), the second driving path 29 is not disconnected. On the other hand, since the first one-way clutch 31 runs idle without engaging with the fourth transfer shaft 35, the first driving path 28 is disconnected. Consequently, the driving torque of the driving motor 24 is transferred to the conveying stirring screw 23 via the second driving path 29 indicated by an arrow in FIG. 2, so that the conveying stirring screw 23 rotates at a high speed.

Figure 3:
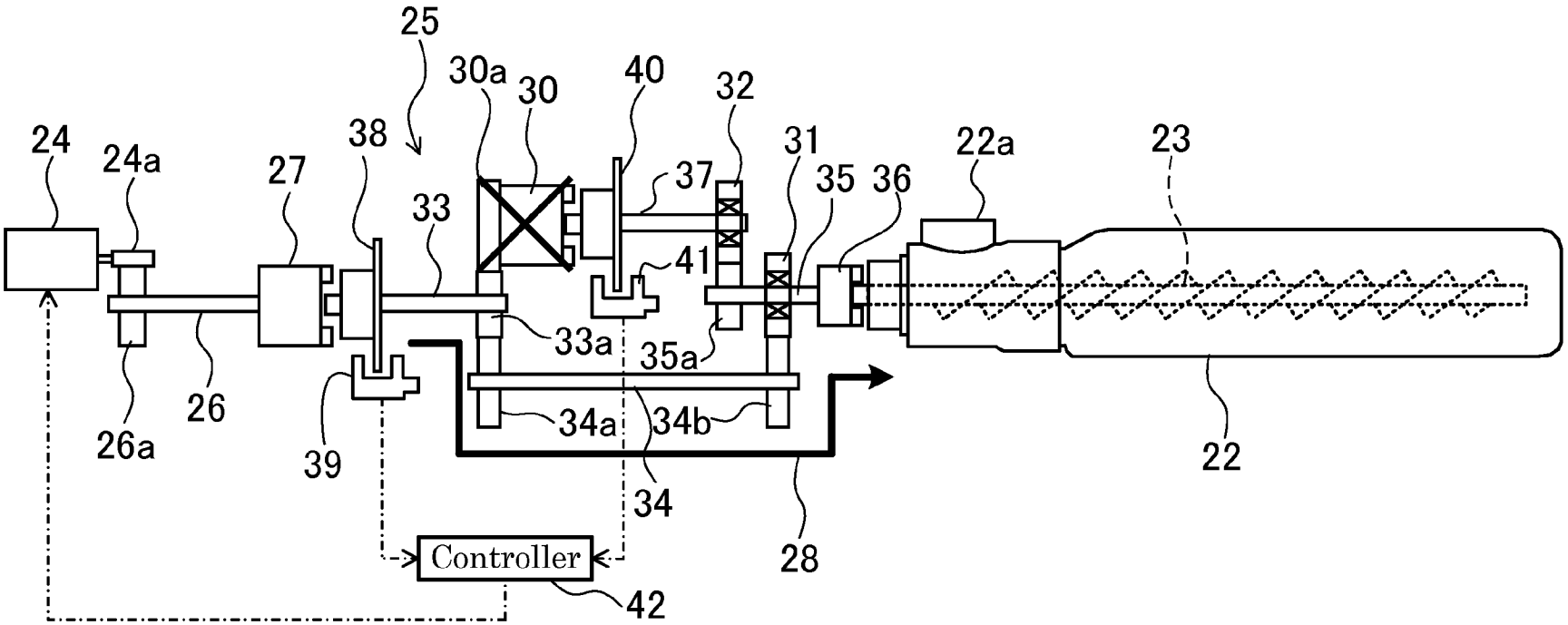
FIG. 3 is an explanation diagram for explaining that untransferred toner is in a nearly full recovery stage in an untransferred toner recovery device according to an embodiment.

When the amount of collected untransferred toner increases in the recovery container 22 and it reaches a nearly full recovery stage near a full state, the rotating torque of the conveying stirring screw 23 reaches the setting torque value of the second torque limiter 30 and the second torque limiter 30 operates (slips) as indicated by 'X' in FIG. 3, so that the second driving path 29 is disconnected. In this way, the driving torque of the driving motor 24 is not transferred to the conveying stirring screw 23 from the second driving path 29. The second photointerrupter 41 detects this fact and inputs a detection signal to the controller 42. The controller issues an alarm, so that an operator can recognize the nearly full state near a full. On the other hand, since the first torque limiter 27 has not operated (slipped) yet and the aforementioned second driving path 29 has been disconnected, the first one-way clutch 31 having run idle up to now is engaged with the fourth transfer shaft 35. Consequently, the driving torque of the driving motor 24 is transferred to the conveying stirring screw 23 via the first driving path 28 as indicated by an arrow in FIG. 3, so that the conveying stirring screw 23 rotates at a low speed.

Figure 4:
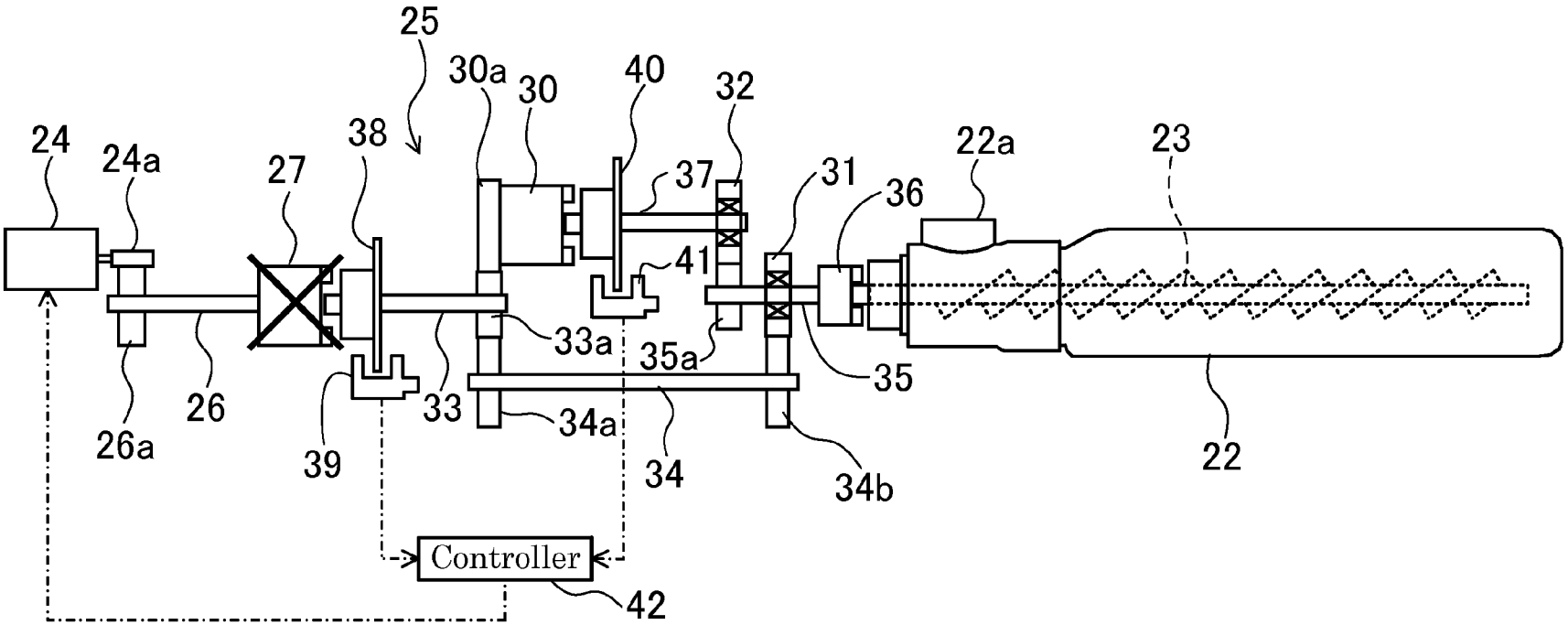
FIG. 4 is an explanation diagram for explaining that untransferred toner is in a full recovery stage in an untransferred toner recovery device according to an embodiment.

When the amount of the collected untransferred toner further increases in the recovery container 22 and it reaches a full recovery stage which is a full state, the rotating torque of the conveying stirring screw 23 reaches the setting torque value of the first torque limiter 27 and the first torque limiter 27 operates (slips) as indicated by 'X' in FIG. 4, so that the first driving path 28 is also disconnected. In this way, the driving torque of the driving motor 24 is not transferred to the conveying stirring screw 23 from the first driving path 28, so that the entire driving transfer system is completely disconnected and thus the conveying stirring screw 23 is stopped. The first photointerrupter 39 detects this fact and inputs a detection signal to the controller 42. The controller 42 outputs a stop signal to the driving motor 24 and also outputs the stop signal to other driving systems of the image forming apparatus 1, thereby prohibiting image formation.

As described above, the untransferred toner recovery device 21 of the embodiment determines the nearly full recovery stage of untransferred toner due to the disconnection of the second driving path 29 by the second torque limiter 30 and further the full recovery stage of the untransferred toner due to the disconnection of the first driving path 28 by the first torque limiter 27, so that it is possible to avoid erroneous detection due to untransferred toner flying up in the recovery container as in Patent Literature 1, and thus it is possible to exchange the recovery container 22 at a proper timing.

Furthermore, the amount of untransferred toner collected in the recovery container 22 is determined into two stages of the nearly full recovery stage and the full recovery stage, so that it is possible to reliably know the exchange time of the recovery container 22.

What is claimed is:

1. An untransferred toner recovery device comprising:

a recovery container that collects untransferred toner removed from a surface of a photosensitive drum at a cleaning unit as waste toner;

a conveying stirring screw provided in the recovery container to be connected to a driving source via a driving path, and to stir and uniformize the collected untransferred toner while conveying the collected untransferred toner by a rotation operation; and a torque limiter provided to the driving path to detect rotating torque of the conveying stirring screw and block torque transfer to the conveying stirring screw by disconnecting the driving path when the rotating torque increases up to a setting value according to an increase in an amount of the collected untransferred toner, wherein the driving path has a first driving path between the driving source and the conveying stirring screw and a second driving path between the driving source and the conveying stirring screw, the torque limiter has a first torque limiter connected to the driving source and a second torque limiter provided to the second driving path, a setting torque value of the first torque limiter is set to be larger than a setting torque value of the second torque limiter, an upstream end of the first driving path and an upstream end of the second driving path are connected to the first torque limiter, a downstream end of the first driving path and a downstream end of the second driving path are connected to the conveying stirring screw via a one-way clutch, and the one-way clutch is configured to transfer driving torque of the driving source to the conveying stirring screw from the second driving path but transfer no driving torque of the driving source from the first driving path in an initial recovery stage of the collected untransferred toner, to switch the driving torque of the driving source to the first driving path from the second driving path when an amount of the collected untransferred toner increases, the rotating torque of the conveying stirring screw reaches the setting torque value of the second torque limiter, and the second driving path is disconnected, and to prevent the driving torque of the driving source from being transferred to the conveying stirring screw from the first driving path when the amount of the collected untransferred toner further increases, the rotating torque of the conveying stirring screw reaches the setting torque value of the first torque limiter, and the first driving path is disconnected.

2. The untransferred toner recovery device of claim 1, further comprising:

a first detection unit which detects that the first driving path has been disconnected by an operation of the first torque limiter is provided at a side of the first torque limiter; and a second detection unit which detects that the second driving path has been disconnected by an operation of the second torque limiter is provided at a side of the second torque limiter, wherein the first detection unit and the second detection unit are connected to a control unit, and the control unit issues an alarm when recognizing a nearly full recovery stage in which the collected untransferred toner is nearly full on a basis of a detection signal of the second detection unit, and prohibits image formation when recognizing a full recovery stage in which the collected untransferred toner is full on a basis of a detection signal of the first detection unit.

3. An image forming apparatus comprising the untransferred toner recovery device of claim 1.

* * * * *